United States Patent [19]

Scott et al.

[11] 4,141,303

[45] Feb. 27, 1979

[54] ROTARY KNIFE MODULE FOR TUFTING MACHINES

[75] Inventors: Jimmie D. Scott, Harrison, Tenn.; William F. Weldon, Austin, Tex.

[73] Assignee: Spencer Wright Industries, Inc., Chattanooga, Tenn.

[21] Appl. No.: 872,881

[22] Filed: Jan. 27, 1978

[51] Int. Cl.[2] ..... D05C 15/00

[52] U.S. Cl. ..... 112/79 R; 83/491; 83/169; 112/301

[58] Field of Search ..... 112/79 R, 301, 124 R, 112/DIG. 3; 83/523, 425.3, 591, 521, 491, 169

[56] References Cited

U.S. PATENT DOCUMENTS

| | | | |
|---|---|---|---|
| 1,728,734 | 9/1929 | Klien | 112/124 |
| 2,103,798 | 12/1937 | Taradash | 112/79 R |
| 2,498,707 | 2/1950 | Rachels | 83/169 |
| 2,990,858 | 7/1961 | Ledger | 83/523 |
| 3,052,198 | 9/1962 | Whitney | 112/79 R |
| 4,012,992 | 3/1977 | Smreker et al. | 83/491 |

FOREIGN PATENT DOCUMENTS

| | | | |
|---|---|---|---|
| 76466 | 9/1950 | Denmark | 112/79 R |
| 2452226 | 5/1975 | Fed. Rep. of Germany | 112/79 R |

*Primary Examiner*—Ronald Feldbaum
*Attorney, Agent, or Firm*—Alan Ruderman

[57] ABSTRACT

A cut-pile tufting machine is disclosed having a module rotatably supporting a plurality of circular knife blades driven by fluid driven turbine wheels. The module includes a nozzle for each turbine wheel communicating with a manifold within the body of the module. The module also includes a fluid passageway communicating with the manifold and a source of fluid supplied under pressure to a plurality of modules. Each knife blade acts within a slot of a tufting machine hook to cut the loops of yarn as they move thereon.

16 Claims, 4 Drawing Figures

ROTARY KNIFE MODULE FOR TUFTING MACHINES

BACKGROUND OF THE INVENTION

This invention relates to tufting machines and more particularly to cut-pile machines of this type having knife blades for cutting loops of yarn while on the hooks shortly subsequent to the formation of the loops.

In conventional cut-pile tufting machines the loops that are formed by the cooperation of the individual needles and loop seizing blade of the hook are severed on the blade to form cut pile. To cut the loop a knife is disposed on one face of each of the hooks having a cutting edge that cooperates with the underside of the loop seizing blade. In such machines the knives are carried by an knife holder secured to an oscillating knife shaft. The knives are formed of spring steel and must be arranged at a slight angle and canter relative to the respective hook to provide tension to insure proper sissor-like cutting action between the cutting edges of the knife and hook. Quite obviously the friction between the knife and hook produces wear on the knives and hooks, and limits the speed of such machines.

To provide proper cutting without having loose or jagged ends of yarn, the cutting edge of the knives must be kept sharp. This requires periodic removal and replacement while the edges are reground. For example, in the typical prior art arrangement, such as illustrated in U.S. Pat. No. 3,386,398 of J. A. Cobble Sr. et al., two knives are set in a knife block secured to the hook shaft. Since such machines may have 1000 or more knives, replacement and resetting of the knives at the proper angles can be a tedious time consuming operation requiring significant machine downtime and labor.

Modular block constructions have been proposed in attempts to reduce downtime due to knife changes and to extend the life of the knife. For example, in German Auslegeschrift No. 23,49,800 of K-H Zieseniss, a slotted knife block is slidably mounted in a runner rail by means of a dove tail guideway and the runner rail is thereafter conventionally mounted in the knife shaft. The knives are first set in the block on a bench, and the complete block can be replaced as a unit. U.S. Pat. No. 3,212,467 of Wittler illustrates a similar concept. In these and other attempts at modules conventional tufting knives have been used with all their inherent problems.

Other deficiencies with the conventional tufting cutters include the requirement of properly timing the knife shaft to the hook shaft, and what is known as "J" cut. This is the condition where the legs of a cut loop are not the same length and thus the resulting pile height is not level. This results from the knife cutting against one face of the hook while the loop extends about the entire hook section. There have been many attempts to solve this problem using conventional knives, with varying degrees of success. Nonconventional attempts have been made using a rotary cutter acting within a slot cut in the hook. Examples of this approach are illustrated in U.S. Pat. No. 2,103,798 of Taradash, U.S. Pat. No. 3,052,198 of Whitney and Danish Pat. No. 76,466 of Bonnesen. However, these proposed constructions could not be used readily for machines operating at relatively high speeds and producing the fine gauge tufted product required by today's market.

SUMMARY OF THE INVENTION

The present invention overcomes the problems of the prior art cut-pile tufting machines by providing a module carrying a plurality of rotary knife blades, each module having its own included drive members, and being installed and removed readily from a tufting machine in a matter of minutes. A plurality of such modules may be mounted in the bed of a multi-needle tufting machine.

In the preferred embodiment the module drive system includes at least one fluid driven turbine wheel mounted on a common shaft with a plurality of circular blades. A nozzle for each turbine is carried by the module for supplying fluid from a manifold formed in the module body to drive the turbine and thus the blades. The module may be removably secured to a bracket in the machine and includes means for readily connecting it to a fluid supply source. Preferably the working fluid would be air and each module would include more than one turbine wheel.

Included among the numerous advantages of this invention is the elimination of the tufting machine mechanical means of driving the blades with the associated timing problems. Simplified mounting of the cutters is made possible with the advantage of very short down times. Since each module carries its own drive means the use of a plurality of such modules mounted in a multi-needle tufting machine would overcome the prior art limitations of cut-pile machines and thus it makes fine gauge cut-pile tufted products a practical reality. Moreover, since rotary cutting blades are used, the blade cutting edge touches only the yarn, so that the rotary cutter advantages of longer cutter life and elimination of "J" cutting is attainable. Other advantages that result from the practice of the present invention include the removal of lint from the hooks and needles by the working fluid, especially air, as it leaves the turbines. Another advantage made possible is that of using the fluid to support the cutters on fluid bearings.

Consequently, it is a primary object of the present invention to provide a module carrying a plurality of rotary cutting blades and blade drive members that readily can be installed in a tufting machine.

It is another object of the present invention to provide a yarn cutting module that can be incorporated into a tufting machine for producing fine gauge cut-pile products.

It is a further object of the present invention to provide a yarn cutting module for tufting machines having a plurality of rotary cutters for cutting yarn while on the hooks of a machine without the cutters touching the hooks.

It is a still further object of the present invention to provide a module carrying a plurality of rotary cutters and at least one fluid driven turbine for driving the cutters.

It is yet another object of the present invention to provide a module carrying a plurality of rotary cutters, at least one turbine for driving the cutters and a nozzle for supplying a fluid to impinge upon and drive each turbine.

It is still yet another object of the present invention to provide a module carrying a plurality of rotary cutters, a plurality of turbines operatively connected to the cutters for rotatably driving them, a nozzle for supplying a high velocity working fluid to impinge upon and drive each turbine, a fluid manifold for supplying fluid from a source to each nozzle, and quick connecting means for securing the module in a tufting machine and for communicating the module with a fluid source.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
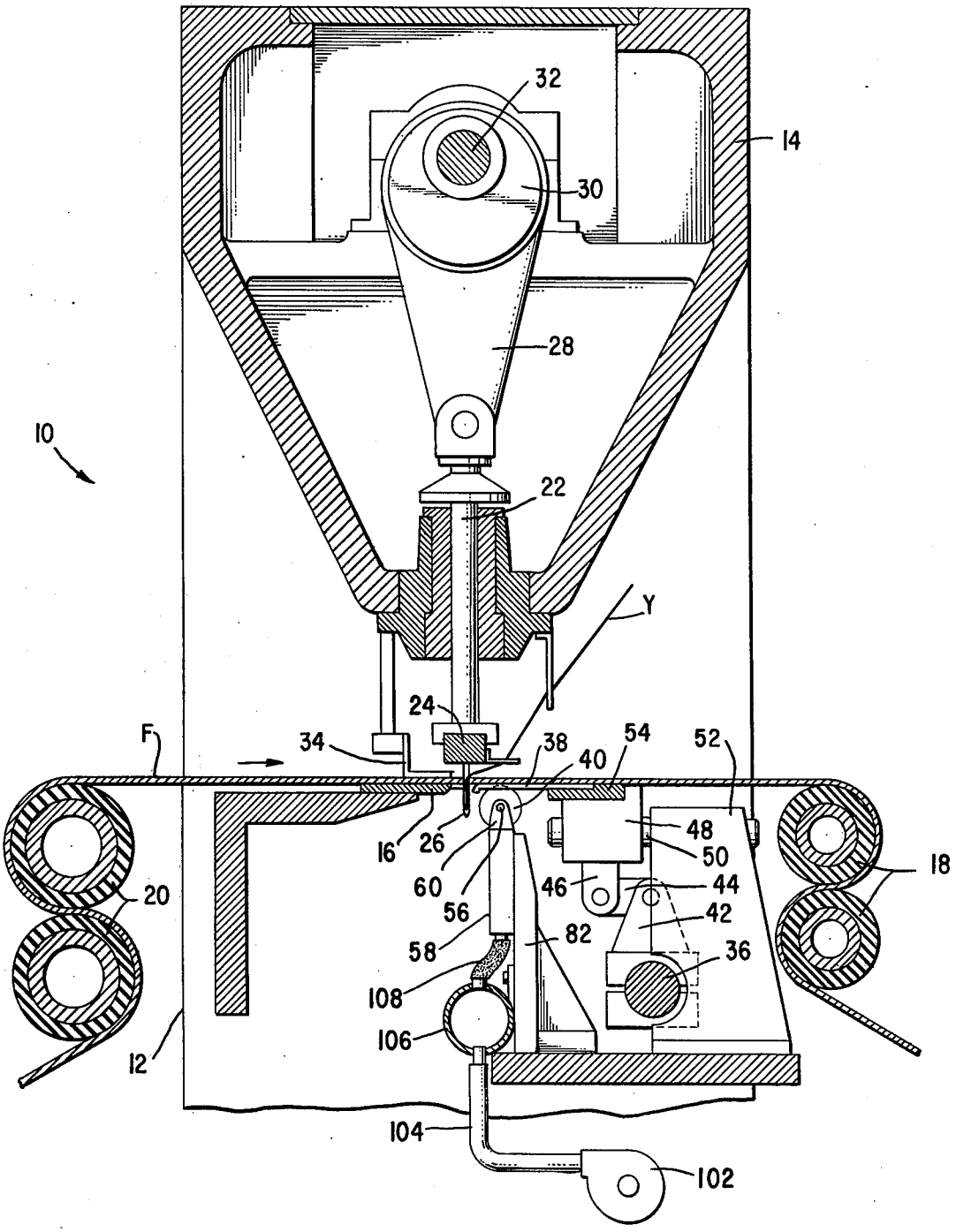
FIG. 1 is a vertical sectional view taken through a tufting machine embodying a cutter module constructed in accordance with the present invention.

Referring now to the drawings, there is illustrated in FIG. 1 a tufting machine 10 having a frame comprising a bed 12 and a head 14 disposed above the bed. The bed 12 includes a bed plate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F on the bed plate 16 upon reciprocation of the needle bar 24 to project loops of yarn therethrough. Endwise reciprocation is imparted to the push rods 22 and thus the needle bar 24 and needles 26 by a link 28 which is pivotably connected at its lower end to the push rods 22 and at its upper end to an eccentric 30 on a driven rotary main shaft 32 that is journalled longitudinall in the head 14. A presser foot assembly 34 may be supported on the head 14 to hold down the fabric F during needle retraction.

Beneath the bed plate 16 there is journalled an oscillating looper shaft 36 arranged parallel to the main shaft 32 for driving a plurality of loopers or hooks 38 in timed relationship with the needle reciprocation. Each hook cooperates with a respective needle 26 to seize a loop of yarn Y presented by the needle and to hold the same as the needle is withdrawn on its return stroke, after which the hooks retract. The loopers being of the cut-pile variety face opposite the direction of feed of the fabric F and as is conventional a number of loops remain on the hooks prior to being cut by a sharp periphery circular knife blade 40, which in accordance with the principles of the present invention is a rotatable disk. The hooks preferably include a slot 41 at the bottom for receiving the blade 40 so that the blades touch only the yarn. By means of a hook with a clip and pattern attachment similar to that illustrated in Card U.S. Pat. No. 3,084,645, selected loops may be withdrawn prior to cutting. While, to simplify the disclosure, only a single needle 26 and single looper 38 is shown, it is understood that a multiplicity of such elements are normally provided laterally across the machine, and that the number may be upwards of 1,000 of each such elements.

Because of the cutting action of the rotary cutting blade 40 it is preferable that the movement of the hook be substantially linear. Thus, the oscillating motion of the shaft 36 is transferred to a lever 42 to which one end of a link 44 is pivotably connected. The other end of the link 44 is pivotably connected to another lever 46 secured to a linear bearing 48 that journally receives a shaft 50 extending in the direction of movement of the hook 38. The shaft 50 is fixed at the end remote from the hook in a standard 52 secured to the bed 12. A hook bar 54 is secured at the upper end of the bearing 48 and carries a plurality of the hooks.

Figure 2:
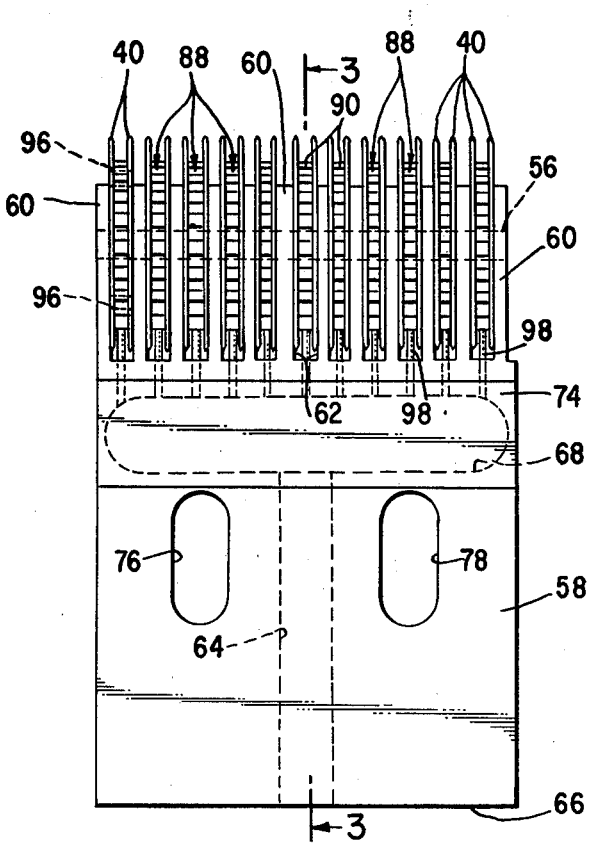
FIG. 2 is a front elevational view of the cutter module illustrated in FIG. 1.

In accordance with the principles of the present invention each knife blade 40 is mounted on a shaft 56 carried by a module 58. Any practical number of such knife blades may be carried by a module, there being 22 such blades in the disclosed module as illustrated in FIG. 2. The gauge of the tufting machine will probably determine the number in most cases and the number of needles will determine the number of modules installed in the machine. As illustrated, the module may comprise a substantially rectangular body member, the width across the front being determined by the number of knives carried, while the width at the ends are narrow and may, as illustrated, be narrower than the diameter of the rotary knives 40. The upper portion of the module includes a plurality of support fingers 60, defining knife blade receiving slots or spaces 62 between each two adjacent support fingers. A substantially central bore 64 defining a fluid passageway is formed in the module and extends from the bottom face 66 upwardly to communicate with a hollow 68 milled across the face 70 of the module adjacent to but below the bottom of the spaces 62 to a depth slightly short of the rear face 72. A cover plate 74 covers the frontal opening in the face 70 to enclose the hollow 68 which defines a fluid manifold for purposes which will hereinafter become clear. A pair of apertures 76 and 78 may be formed through the module from front to rear for receiving conventional securing members 80 for attaching to a bracket 82 in the bed 12 of the tufting machine. The lowermost portion of the bore 64 may be tapped to provide a threaded connection 84 for a nipple 86 communicating the module with a source of fluid as hereinafter explained.

Figure 4:
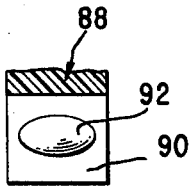
FIG. 4 is a partial cross sectional view taken along line 4—4 of FIG. 3 illustrating the face of one turbine blade.
Figure 3:
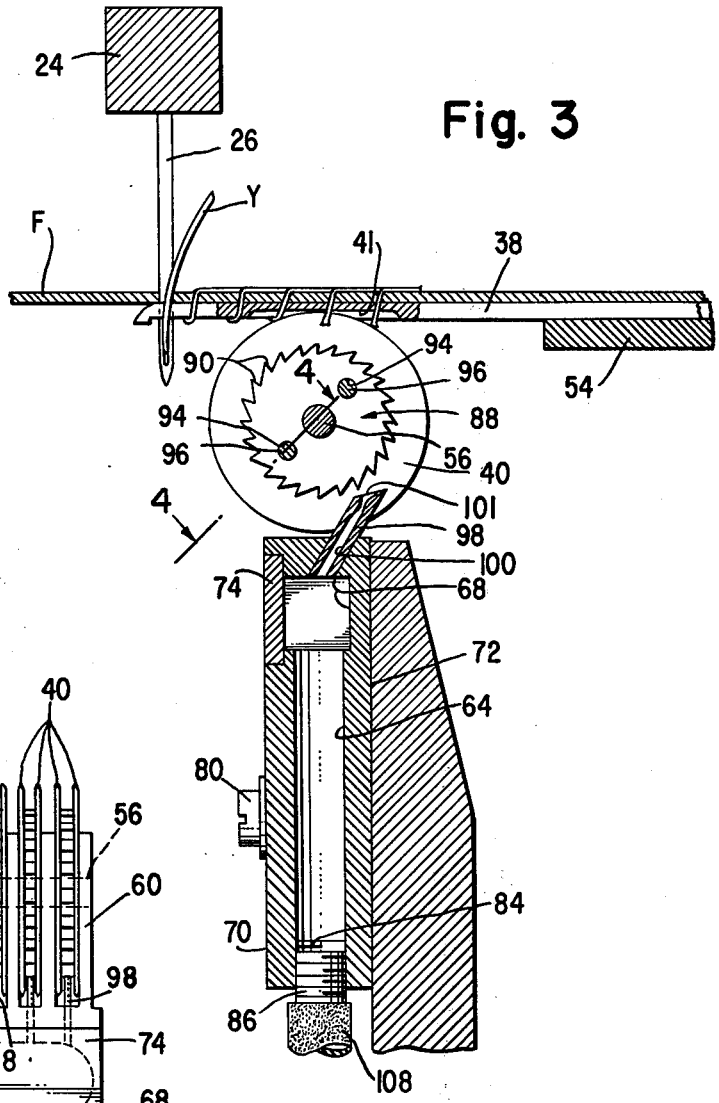
FIG. 3 is a vertical sectional view similar to FIG. 1, but enlarged and fragmented, taken substantially along line 3—3 of FIG. 2 and illustrating the cutting action of one knife blade.

The means for rotatably driving the knife blades 40 includes a fluid driven turbine wheel 88 having a multipicity of blades or teeth 90 spaced equally about the periphery thereof. It is contemplated that the turbine wheels can be inexpensively cast from a synthetic plastic material — possibly nylon — and include small recessed pockets 92 as illustrated in FIG. 4 for effective utilization of the kinetic energy of the fluid impinging thereon. In the preferred embodiment there is one turbine wheel associated with and sandwiched between two circular knife blades 40, so there is one on each side of the turbine wheel, positioned in each space 62 as a unit. Other combinations are readily visualized and the two blade and one turbine unit should not be construed as a limitation of the invention. The shaft 56 extends through all the support fingers 60 for carrying all the turbine wheel and knife blade units of a module. It is presently preferred that the turbine wheels 88 include one or more small holes 94 through the face thereof, each for receiving a pin 96 that is also received in a similar hole (not illustrated) in the face of the knife blades for radially locking each turbine wheel and its associated blades for rotation together as a unit on the shaft 56. Obviously, other means for securing the units for rotation may be readily realized, such as, for example, securing each element to the shaft directly so that the shaft itself also rotates with the blades and turbine wheels.

In order to effectively transfer energy of a fluid to the turbines each turbine has a nozzle 98 associated therewith. The nozzle preferably may be an insert having a converging-diverging internal configuration for good energy conversion of air — the preferred fluid — from a substantially static condition to a kinetic or high velocity condition, but it may alternately have a different configuration depending on factors such as the fluid and the fluid pressure used. The inlet portion of the nozzle insert is fitted within an angularly bored aperture 100 and communicates with the fluid manifold 68 and the outlet 101 is positioned adjacent to the turbine wheel blades 90. Thus, a pressurized fluid in the manifold 68 is expelled at a relatively high velocity through the nozzles of the module to impinge upon and drive the respective turbine 88 thereby rotatably driving the knife blades 40.

Because of its economics, conveniences and advantages, air is the preferred fluid. The air may be delivered to the modules under pressure by conventional means such as a compressor illustrated schematically at 102. The air from the compressor may then flow through tubing 104 to a central manifold 106 secured to the bracket 82 in the bed 12 of the tufting machine for supplying a number, and possibly all, of the modules through tubing 108 attached to the manifold nipples 86.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A rotary knife module carrying a plurality of spaced apart circular knife blades, at least one turbine wheel drivingly connected to said knife blades, means for rotatably mounting said knife blades and turbine wheel in said module with the periphery of said blades free for cutting, a nozzle for impinging a fluid upon each turbine wheel, said nozzle having an outlet and an inlet supported in said module with the outlet disposed adjacent said turbine wheel, said module including a body member having means defining a hollow cavity therein communicating with the inlet of said nozzle, and means for communicating said cavity with a source of fluid.

2. A rotary knife module as recited in claim 1 including a plurality of turbine wheels, each turbine wheel being drivingly connected to at least two knife blades, and a nozzle for each turbine communicating with said cavity.

3. A rotary knife module as recited in claim 2 wherein each turbine wheel is connected between two knife blades.

4. A rotary knife module as recited in claim 3 wherein said means for rotatably mounting said knife blades and turbine wheels includes a plurality of support fingers, and a common shaft carried by said fingers, said knife blades and turbine wheel being supported for rotation on said shaft.

5. A rotary knife module as recited in claim 1 wherein said turbine wheel comprises a multiplicity of teeth spaced about the periphery thereof, each of said teeth having a recessed pocket.

6. A rotary knife module as recited in claim 1 wherein said means for communicating said cavity with a source of fluid comprises means defining a central bore in said body member opening into said cavity, and connecting means for connecting said bore to external tubing means.

7. A rotary knife module as recited in claim 6 wherein two knife blades and one turbine wheel define a rotary unit, each rotary unit has the turbine sandwiched between said knife blades and connected thereto, said means for rotatably mounting said knife blades and turbine wheels comprising a plurality of spaced support fingers, a rotary unit being disposed between each adjacent pair of fingers, and a common shaft supported by said fingers and journally carrying said rotary units.

8. In a tufting machine having a plurality of reciprocating needles adapted to carry yarn and to penetrate a backing fabric from one side thereof, a loop seizing hook associated with each needle and mounted on the other side of the backing fabric for seizing a loop of yarn presented by the needle to form loops of pile extending from the backing fabric, and cutting means associated with at least some of the loop seizing hooks for cutting loops of yarn while on said hooks, said cutting means comprising a module having a plurality of circular knife blades, each cooperating with a respective loop seizing hook, at least one turbine wheel drivingly connected to said knife blades, means for rotatably mounting said knife blades and turbine wheel in said module, a fluid dispensing nozzle having an outlet disposed adjacent said turbine wheel for impinging a fluid thereon to rotatably drive the turbine and said blades, and means for supplying a fluid under pressure to said nozzle.

9. In a tufting machine as recited in claim 8 wherein said module comprises a body member, said means for supplying a fluid under pressure to said nozzle comprising means defining a hollow cavity in said body member, said nozzle having an inlet supported in said module in flow communication with said cavity, means defining a fluid passageway in said body member communicating with said hollow, and means for supplying fluid under pressure to said passageway.

10. In a tufting machine as recited in claim 8 wherein said module includes a plurality of turbine wheels, each turbine wheel being drivingly connected to at least two knife blades, and a nozzle for each turbine communicating with said hollow cavity.

11. In a tufting machine as recited in claim 10 wherein each turbine wheel is connected between two knife blades.

12. In a tufting machine as recited in claim 11 wherein said means for rotatably mounting said knife blades and turbine wheels includes a plurality of support fingers, and a common shaft carried by said fingers, said knife blades and turbine wheel being supported for rotation on said shaft.

13. In a tufting machine as recited in claim 9 wherein two knife blades and one turbine wheel define a rotary unit, each rotary unit has the turbine sandwiched between the knife blades and connected thereto, said means for rotatably mounting said knife blades and turbine wheels comprising a plurality of spaced support fingers, and a common shaft supported by said fingers and journally carrying said rotary units.

14. In a tufting machine as recited in claim 8 wherein said turbine wheel comprises a multiplicity of teeth spaced about the periphery thereof, each of said teeth having a recessed pocket.

15. In a tufting machine as recited in claim 8 wherein said loop seizing hooks include a recess for receiving at least the periphery of a respective knife blade, hook driving means for reciprocating said hooks substantially linearly into loop seizing relationship with said needles and relatively to said knife blades, said hook driving means comprising a linear bearing member supported for reciprocation in said machine, means securing said hooks to said linear bearing member, an oscillating shaft driven in timed relationship with said needles, and means connecting said oscillating shaft to said linear bearing member for reciprocating said member.

16. In a tufting machine as recited in claim 9 wherein said tufting machine includes a plurality of said modules, said means for supplying fluid under pressure to said passageway includes a common manifold for said modules, and means for supplying fluid under pressure to said common manifold.

* * * * *